US010694851B2

(12) United States Patent
Zhu et al.

(10) Patent No.: US 10,694,851 B2
(45) Date of Patent: Jun. 30, 2020

(54) MULTIFUNCTIONAL GRANDSTAND CHAIR

(71) Applicant: ZHEJIANG SUNSHINE LEISURE PRODUCTS CO., LTD., Jinhua, Zhejiang Province (CN)

(72) Inventors: Xiaohui Zhu, Jinhua (CN); Xuefeng Zheng, Jinhua (CN)

(73) Assignee: ZHEJIANG SUNSHINE LEISURE PRODUCTS CO., LTD., Jinhua, Zhejiang Province (CN)

( * ) Notice: Subject to any disclaimer, the term of this patent is extended or adjusted under 35 U.S.C. 154(b) by 7 days.

(21) Appl. No.: 16/048,646

(22) Filed: Jul. 30, 2018

(65) Prior Publication Data

US 2019/0374034 A1 Dec. 12, 2019

(30) Foreign Application Priority Data

Jun. 6, 2018 (CN) ..... 2018 2 0871303 U

(51) Int. Cl.

| | |
|---|---|
| ***A47C 4/28*** | (2006.01) |
| ***A47C 7/40*** | (2006.01) |
| ***A47C 1/16*** | (2006.01) |
| ***A47C 4/34*** | (2006.01) |
| ***A47C 4/44*** | (2006.01) |

(52) U.S. Cl.

CPC ..... *A47C 4/28* (2013.01); *A47C 1/16* (2013.01); *A47C 4/34* (2013.01); *A47C 4/44* (2013.01); *A47C 7/407* (2013.01)

(58) Field of Classification Search

CPC .. A47C 4/28; A47C 4/286; A47C 4/36; A47C 4/46; A47C 4/34; A47C 4/44; A47C 4/10; A47C 4/20; A47C 5/10

USPC ..... 297/53, 54

See application file for complete search history.

(56) References Cited

U.S. PATENT DOCUMENTS

| | | | | | |
|---|---|---|---|---|---|
| 1,788,832 | A * | 1/1931 | Hamburg | A47C 4/10 | 297/54 |
| 1,914,006 | A * | 6/1933 | Brown | A47C 4/20 | 403/61 |
| 2,603,274 | A * | 7/1952 | McClernon | A47C 4/20 | 297/37 |
| 2,984,294 | A * | 5/1961 | Epstean | A47C 4/20 | 297/54 |

(Continued)

*Primary Examiner* — David R Dunn
*Assistant Examiner* — Tania Abraham
(74) *Attorney, Agent, or Firm* — Muncy, Geissler, Olds & Lowe, P.C.

(57) ABSTRACT

A multifunctional grandstand chair includes a chair frame, a cushion movably arranged on the chair frame, and backrest cloth. The chair frame includes a base frame, a backrest tube and two foot supports, which are respectively pivoted to two sides of the base frame and capable of being inwards folded onto the base frame or outwards unfolded to support the base frame. The multifunctional grandstand chair further includes fixed connecting pieces connected between the base frame and the foot supports to limit the maximum unfolding angle of the foot supports. When the multifunctional grandstand chair needs to be transformed into a grandstand chair structure, the foot supports are folded onto the base frame. When the multifunctional grandstand chair needs to be transformed into a common chair, the foot supports are unfolded to be supported on the ground.

8 Claims, 7 Drawing Sheets

(56) References Cited

U.S. PATENT DOCUMENTS 3,994,529 A * 11/1976 Lippert ..... A47C 1/16 297/252
4,441,756 A * 4/1984 Liou ..... A47C 1/03 297/35
4,577,901 A * 3/1986 Phillips ..... A47C 4/02 224/155
4,889,383 A * 12/1989 Jones ..... A47C 4/02 297/16.1
5,246,265 A * 9/1993 Nagan ..... A47C 3/38 297/31
5,415,455 A * 5/1995 Geldbaugh ..... A47C 4/02 297/16.2
5,529,375 A * 6/1996 English ..... A47C 1/124 297/248
5,567,014 A * 10/1996 Fitch ..... A47C 3/18 297/344.21
5,899,525 A * 5/1999 Tseng ..... A47C 4/20 297/51
5,988,737 A * 11/1999 Tomaiuolo ..... A47C 4/52 297/129
6,012,769 A * 1/2000 Hsueh ..... A47C 3/16 297/19
6,264,078 B1 * 7/2001 Bilang ..... A45C 9/00 224/155
6,698,828 B1 * 3/2004 Chan ..... A47C 4/06 297/51
6,820,928 B1 * 11/2004 Ransom ..... A47C 4/10 297/283.3
8,567,860 B2 * 10/2013 Jue ..... A47C 4/44 297/129
8,864,221 B1 * 10/2014 Delvilla ..... A47C 7/62 297/180.11
9,204,726 B2 * 12/2015 Tseng ..... A47C 4/44
2018/0263372 A1 * 9/2018 Rohrer ..... A47C 13/00

* cited by examiner

MULTIFUNCTIONAL GRANDSTAND CHAIR

BACKGROUND OF THE INVENTION

Technical Field

The invention relates to grandstand chairs, in particular to a multifunctional grandstand chair.

Description of Related Art

Stepped grandstands are mostly constructed in indoor stadiums or outdoor sports fields to particularly serve unspecific users. In order to improve the comfort for people sitting in the grandstands, grandstand chairs can be placed on the grandstands. By the fact that the grandstand chairs are provided with a backrest, armrests and a cushion, the viewers are prevented from directly sitting on the cold steps of the grandstands. Chairs can also be placed on the stepped grandstands to achieve the similar effect for the viewers.

With the single function, grandstand chairs in the prior art can only be applied to grandstands in indoor or outdoor stadiums, thereby being limited in application range.

Moreover, Chinese Utility Model Application No. 201420129855.X discloses a grandstand chair, which includes a cushion with the cloth cover fixed on bottom cross rods. When the grandstand chair is in use, only flexible fabric is used to isolate people from the ground, so that if water accumulates on the ground of grandstands or the temperature of the ground of the grandstands is too low, human bodies will be directly affected, and accordingly, use comfort will be affected.

BRIEF SUMMARY OF THE INVENTION

In view of this, one objective of the invention is to provide a multifunctional grandstand chair, which can be transformed into a structure applicable to grandstands or a conventional chair structure, thereby having multiple functions.

To fulfill the above objective, the invention provides a multifunctional grandstand chair, which includes a chair frame, a cushion movably arranged on the chair frame, and backrest cloth. The chair frame includes a base frame, a backrest tube pivoted to the rear end of the base frame, and two foot supports. The two foot supports are respectively pivoted to two sides of the base frame and capable of being inwards folded onto the base frame or outwards unfolded to support the base frame. The multifunctional grandstand chair further includes fixed connecting pieces connected between the base frame and the foot supports to limit the maximum unfolding angle of the foot supports.

Furthermore, the base frame includes base frame cross rods respectively located at the front end and the rear end and base frame tubes respectively located at the left end and the right end. Each base frame tube is a vertically-arranged annular tube and includes a first tube section located at the upper end, a second tube section located at the lower end, and two connecting tubes connected between the first tube section and the second tube section. The cushion is arranged on the first tube sections of the two base frame tubes.

Furthermore, the multifunctional grandstand chair further includes first foot pads and second foot pads. A gap is reserved between the second tube section and one corresponding connecting tube of each base frame tube. The first foot pads are disposed around the second tube sections via the gaps. Each second foot pad is provided with two connecting grooves and disposed at the corresponding gap. The second tube section and the corresponding connecting tube of each base frame tube are respectively connected to the two connecting grooves of the corresponding second foot pad.

Furthermore, each first foot pad is provided with a hook structure including a hook component and a torsional spring and is formed with an installation hole, wherein the torsional spring is fixed in the installation hole, the hook component includes a hook body, a connecting shaft and a hook, the connecting shaft and the hook are respectively arranged at two ends of the hook body, and the connecting shaft is rotatably arranged in the installation hole. The torsional springs act on the hook bodies, under the acting force of the torsional springs, the hook bodies are attached to the foot supports, and thus, an acting force for inward folding is applied to the hook bodies and the foot supports all the time.

Furthermore, the hook of each hook component is sleeved with a cap.

Furthermore, each foot support is a u-shaped tube and includes two vertical foot tubes and a cross foot tube connected between the two vertical foot tubes. An open end of each foot support is pivoted to the base frame. The cross foot tube of each foot support is supported on the ground.

Furthermore, each cross foot tube is provided with a third foot pad.

Furthermore, each fixed connecting piece includes two connecting rods hinged together, wherein the two connecting rods are respectively hinged to the base frame and the corresponding foot support, and when the two connecting rods are completely unfolded, the unfolding angle between the corresponding foot support and the base frame is limited.

Furthermore, the backrest tube is in an n-shaped tube and includes two vertical backrest tube sections and a cross backrest tube section connected to the upper ends of the two vertical backrest tube sections. An open end of the backrest tube is pivoted to the base frame. The backrest cloth is arranged between the two vertical backrest tube sections.

Furthermore, each vertical backrest tube section is connected to the rear end of the base frame through a rotary connecting piece connected to the base frame and capable of being folded forwards.

The technical scheme provided by the invention has the following beneficial effects:

The two foot supports are additionally arranged on the base frame and can be inwards folded onto the base frame or outwards unfolded to support the base frame; when the multifunctional grandstand chair needs to be transformed into a grandstand chair structure, the foot supports are folded onto the base frame; and when the multifunctional grandstand chair needs to be transformed into a common chair, the foot supports are unfolded to be supported on the ground.

Furthermore, the base frame includes the base frame cross rods respectively located at the front end and the rear end and the base frame tubes respectively located at the left end and the right end, the base frame tubes are vertically-arranged annular tubes, so that a height difference is formed to keep the cushion away from the ground by a certain distance, and thus, the comfort in use is good.

DETAILED DESCRIPTION OF THE INVENTION

Figure 1:
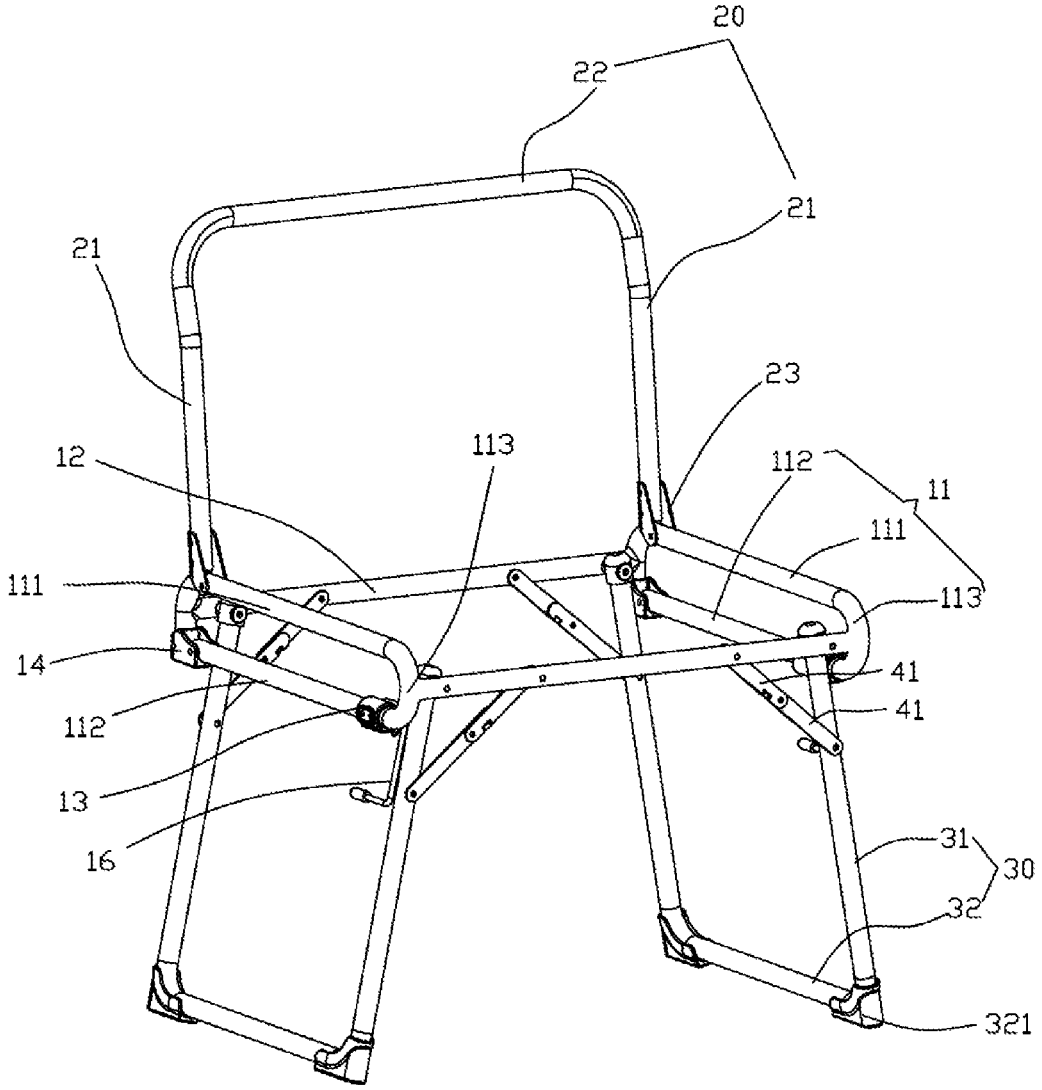
FIG. 1 is a structural view of a multifunctional grandstand chair in the status of being unfolded into a common chair in the embodiment.

In order to further illustrate the embodiments, the drawings are provided by the invention. These drawings are part of the contents disclosed by the invention and mainly used to illustrate the embodiments and to explain the operation principle of the embodiments in combination with relevant description in the specification. By cooperatively referring to these contents, those ordinarily skilled in this field would appreciate other possible embodiments and advantages of the invention. The components in the drawings are drawn not to scale, and similar component signs generally represent similar components.

The invention is further described in combination with the drawings and specific embodiments as follows.

As shown in FIGS. 1-7, a multifunctional grandstand chair in this embodiment includes a chair frame, a cushion 50 movably arranged on the chair frame, and backrest cloth (not shown). The chair frame includes a base frame, a backrest tube 20 and two foot supports 30.

Figure 3:
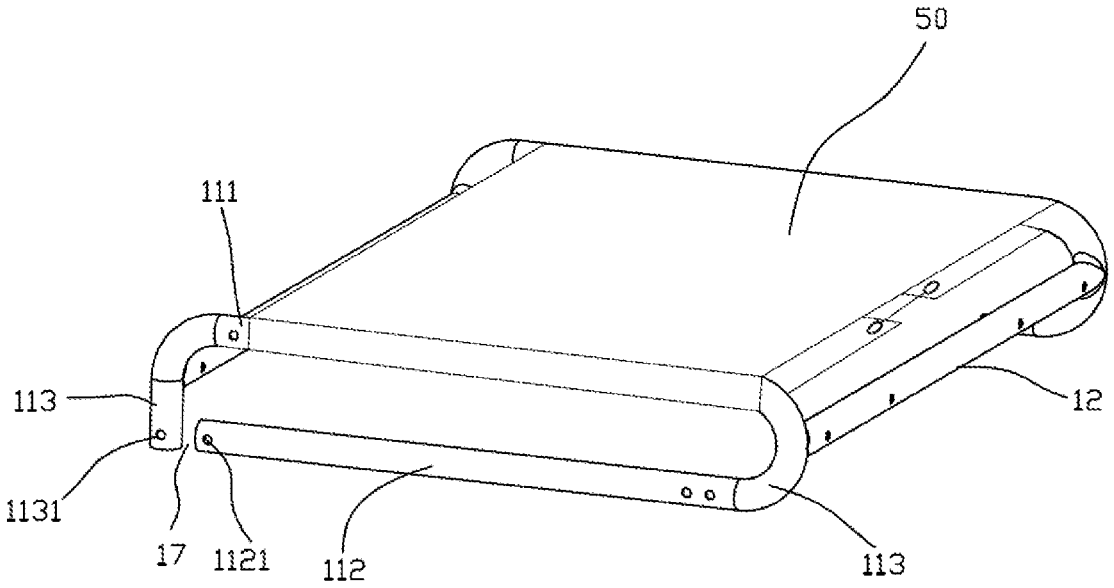
FIG. 3 is a partial structural view of the multifunctional grandstand chair in the embodiment.
Figure 4:
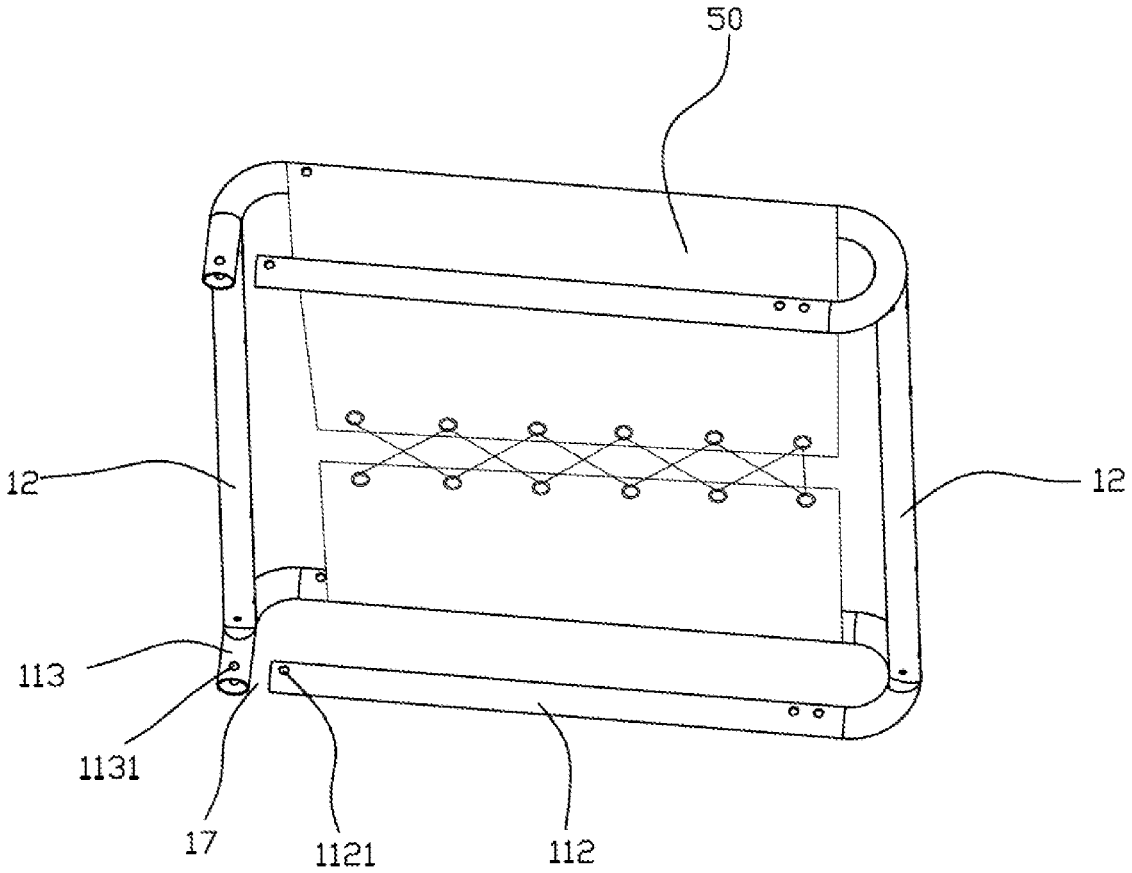
FIG. 4 is a view from another perspective of the structure in FIG. 3.
Figure 5:
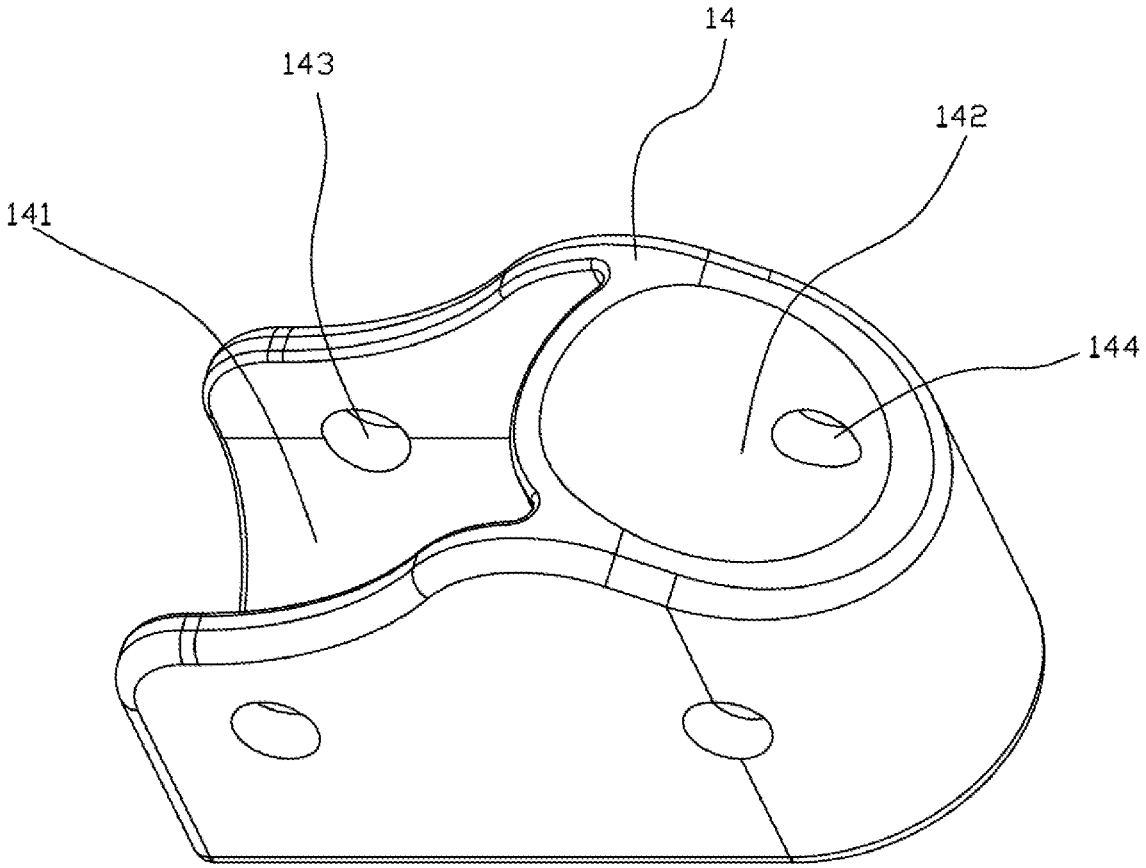
FIG. 5 is a structural view of a second foot pad of the multifunctional grandstand chair in the embodiment.
Figure 6:
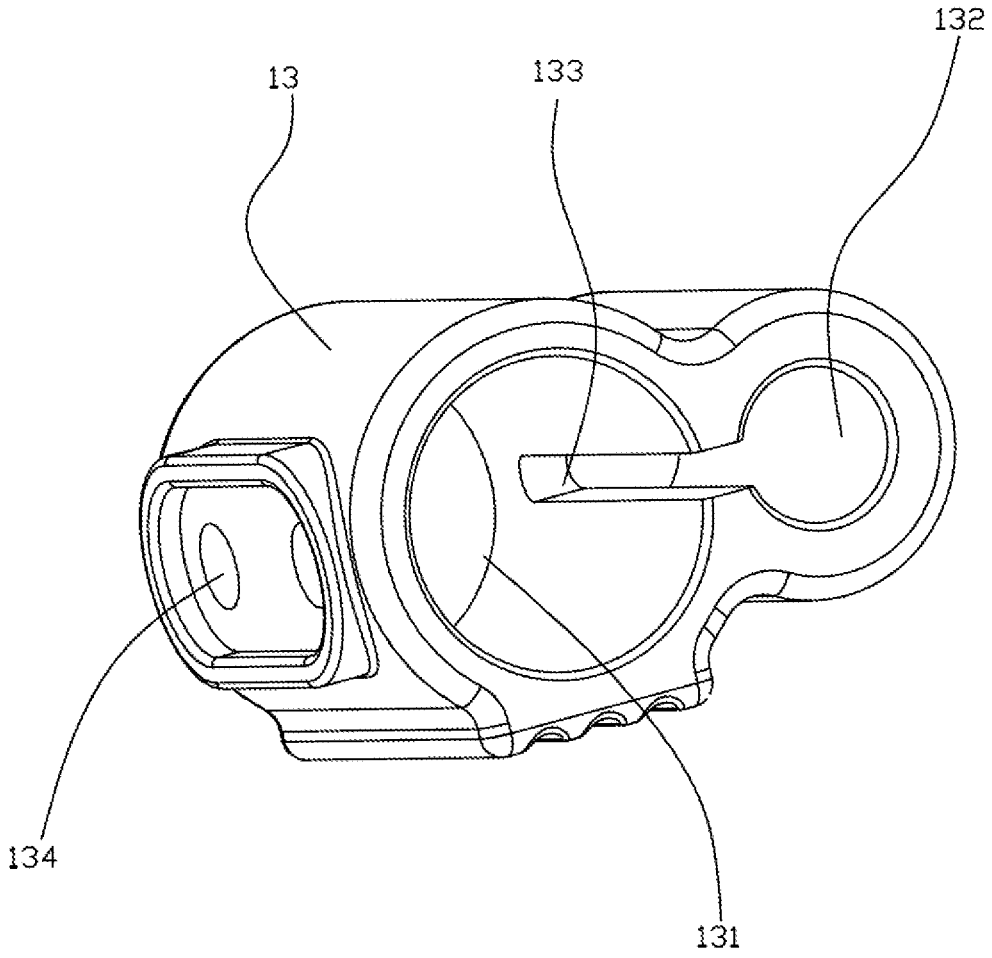
FIG. 6 is a structural view of a first foot pad of the multifunctional grandstand chair in the embodiment.
Figure 7:
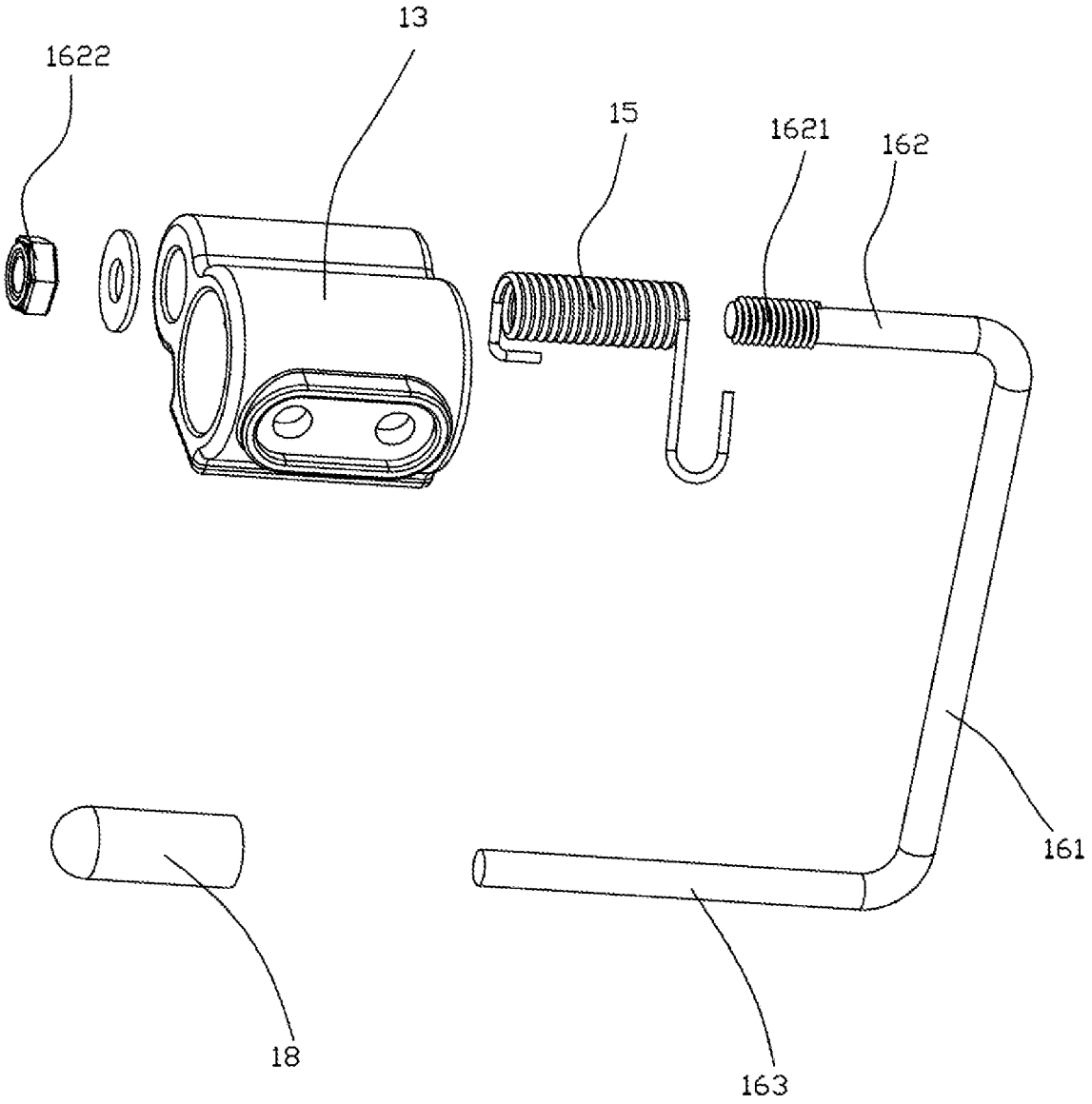
FIG. 7 is an exploded view of a partial structure of the multifunctional grandstand chair in the embodiment.

The base frame includes base frame cross rods 12 respectively located at the front end and the rear end and base frame tubes 11 respectively located at the left end and the right end. Each base frame tube 11 is a vertically-arranged annular tube and includes a first tube section 111 located at the upper end, a second tube section 112 located at the lower end, and two connecting tubes 113 connected between the first tube section 111 and the second tube section 112. The cushion 50 is arranged on the first tube sections 111 of the two base frame tubes 11, as shown in FIG. 3 and FIG. 4.

Furthermore, the multifunctional grandstand chair includes first foot pads 13 and second foot pads 14. A gap 17 is reserved between the second tube section 112 of each base frame tube 11 and one corresponding connecting tube 113 (the connecting tube 113 at the rear end). Each first foot pad 13 is provided with a sleeving hole 131 and is disposed around the corresponding second tube section 112 via the corresponding gap 17. Furthermore, each first foot pad 13 is further provided with fixing holes 134 communicated with the sleeving hole 131. The diameter of the sleeving holes 131 is slightly greater than that of the second tube sections 112 so that the first foot pads 13 can easily move on the second tube sections 112. When the sleeving holes 131 are moved to corresponding positions (the front end of the base frame tubes 11 in this embodiment), fixing parts (such as screw fasteners) fixedly penetrate through the fixing holes 134 and abut against the second tube sections 112 to achieve fixation. Each second foot pad 14 is provided two connecting grooves, which are a first connecting groove 141 and a second connecting groove 142 respectively. The second foot pads 14 are disposed at the gaps 17. The second tube section 112 and the corresponding connecting tube 113 of each base frame tube 11 are respectively connected to the first connecting groove 141 and the second connecting groove 142 of the corresponding second foot pad 14. The first foot pads 13 and the second foot pads 14 are additionally arranged to improve the stability of the chair when the base frame tubes 11 make contact with the ground of grandstands.

Particularly, first connecting holes 143 and second connecting holes 144 are respectively formed in walls of the first connecting groove 141 and the second connecting groove 142 of each second foot pad 14. Third connecting holes 1121 and fourth connecting holes 1131 are respectively formed in the second tube section 112 and the corresponding connecting tube 113. The second tube sections 112 are inserted into the first connecting grooves 141, then the third connecting holes 1121 correspond to the first connecting holes 143, and fixing parts (such as bolts) penetrate through the third connecting holes 1121 and the corresponding first connecting holes 143 to achieve connection. The connecting tubes 113 are inserted into the second connecting grooves 142, then the fourth connecting holes 1131 correspond to the second connecting holes 144, and fixing parts (such as bolts) penetrate through the fourth connecting holes 1131 and the corresponding second connecting holes 144 to achieve connection.

The backrest tube 20 is in an n-shaped tube and includes two vertical backrest tube sections 21 and a cross backrest tube section 22 connected to the upper ends of the two vertical backrest tube sections 21. An open end of the backrest tube 20 is pivoted to the base frame. The backrest cloth is arranged between the two vertical backrest tube sections 21. Furthermore, each vertical backrest tube section 21 is pivoted to the rear end of the base frame through a rotary connecting piece 23, which is connected to the base frame and capable of being folded forwards. Particularly, the rotary connecting pieces 23 are pivoted to the rear end of the base frame, and in this embodiment, the rotary connecting pieces 23 are pivoted to the rear ends of the first tube sections 111. The vertical backrest tube sections 21 of the backrest tube 20 are fixed on the rotary connecting pieces 23.

The two foot supports 30 are respectively pivoted to two sides of the base frame and can be inwards folded onto the base frame or outwards unfolded to support the base frame. Particularly, in this embodiment, each foot support 30 is a u-shaped tube and includes two vertical foot tubes 31 and a cross foot tube 32 connected between the two vertical foot tubes 31. An open end of each foot support 30 is pivoted to the base frame. The cross foot tubes 32 of the foot supports 30 are supported on the ground. The foot supports 30 are u-shaped tubes, so that the structure is simplified while the stability of the supporting structure is ensured, and the weight and cost are reduced. In other embodiments, the foot supports 30 can also be flat plate structures or the like.

Furthermore, in this embodiment, the cross foot tubes 32 are provided with third foot pads 321, thus, having better supporting stability.

The multifunctional grandstand chair further includes fixed connecting pieces connected between the base frame and the foot supports 30 to limit the maximum unfolding angle of the foot supports. Particularly, in this embodiment, each fixed connecting piece includes two connecting rods 41 which are hinged together, wherein the two connecting rods 41 are respectively hinged to the base frame and the corresponding foot support 30, and when the two connecting rods 41 are completely unfolded, the unfolding angle between the corresponding foot support 30 and the base frame is limited to prevent the foot support 30 from continuing to be unfolded, and thus, the whole structure is fixed. In other embodiments, the fixed connecting pieces can also be connecting ropes with certain lengths or other structures.

Figure 2:
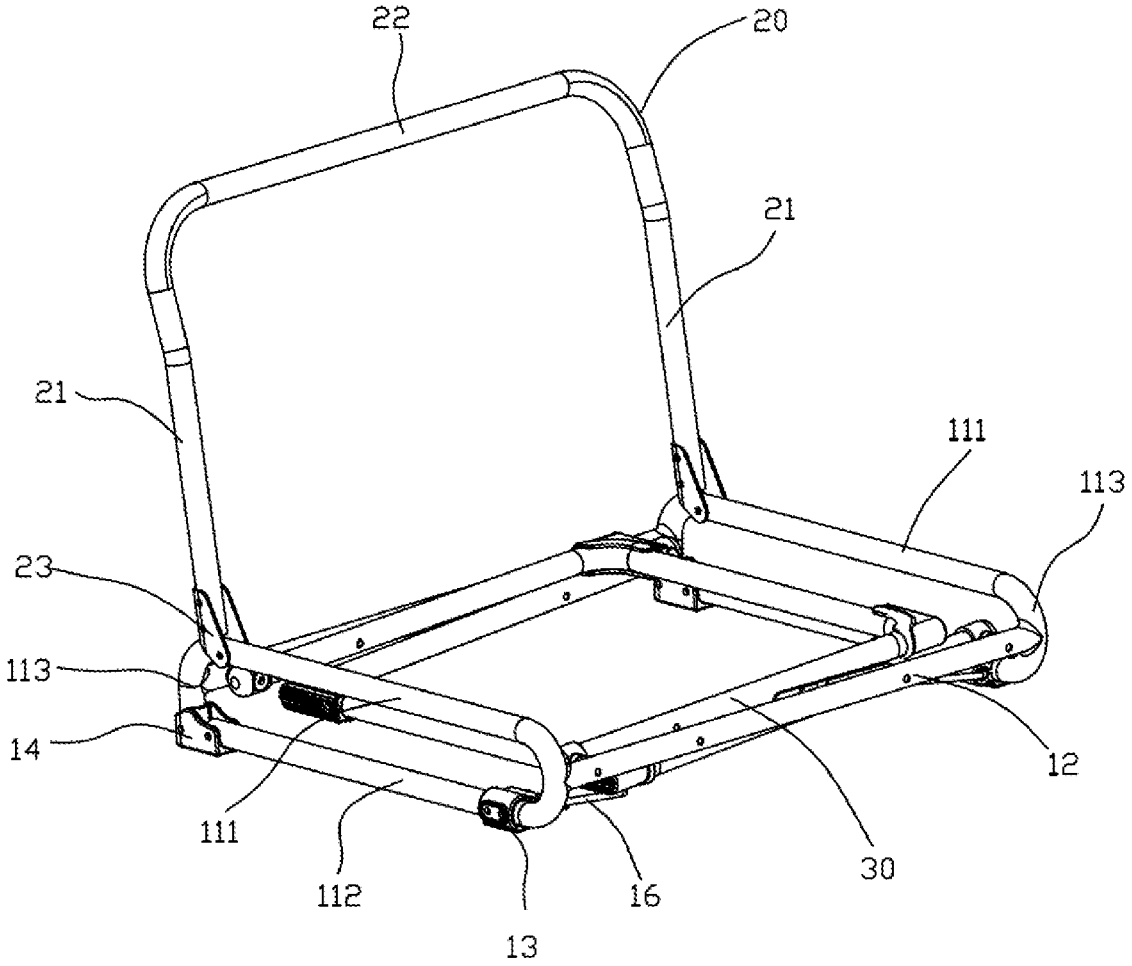
FIG. 2 is a structural view of the multifunctional grandstand chair in the status of being folded into a grandstand chair in the embodiment.

When the multifunctional grandstand chair in this embodiment needs to be transformed into a grandstand chair structure, the two connecting rods 41 of each fixed connecting piece are bent first, and then the foot supports 30 are folded onto the base frame, as shown in FIG. 2. When the multifunctional grandstand chair needs to be transformed into a common chair, the foot supports 30 are unfolded to be supported on the ground, as shown in FIG. 1. When the multifunctional grandstand chair needs to be stored, the backrest tube 20 is folded to be stored on the base frame on the basis of FIG. 1. The multifunctional grandstand chair can serve as a grandstand chair as well as a common outdoor chair, thereby having multiple functions; and meanwhile, the multifunctional grandstand chair has a simple structure and a low weight and cost by the fact that connection is achieved completely through tubes.

Furthermore, in this embodiment, each base frame tube is a vertically-arranged annular tube and includes a first tube section 111 located at the upper end, a second tube section 112 located at the lower end, and two connecting tubes 113 connected between the first tube section 111 and the second tube section 112. The cushion 50 is arranged on the first tube sections 111 of the two base frame tubes, as shown in FIG. 3 and FIG. 4. In this way, a height difference is formed to keep the cushion 50 away from the ground by a certain distance, and thus, the comfort in use is good. In other embodiments, single tube structures can also be adopted to achieve the same effect.

Furthermore, in this embodiment, each first foot pad 13 is further provided with a hook structure including a hook component 16 and a torsional spring 15 and is formed with an installation hole 132, wherein a through gap 133 is reserved between the installation hole 132 and the corresponding sleeving hole 131, the torsional spring 15 is fixed in the installation hole 132, and the torsional spring 132 is provided with a torsional arm fixed in the through gap 133. Each hook component includes a hook body 161, a connecting shaft 162 and a hook 163, wherein the connecting shaft 162 and the hook 163 are respectively arranged at two ends of the hook body 161, the connecting shaft 162 is rotatably arranged in the corresponding installation hole 132, particularly, an external thread 1621 is tapped at the tail end of the connecting shaft 162, a nut 1622 is assembled at the other end of the installation hole 132, the connecting shaft 162 is rotatably penetrates through the installation hole 132, and the external thread 1621 at the tail end of the connecting shaft 162 is connected with the nut 1622 in a threaded mode. Each torsional spring 15 is provided with another torsional arm acting on the corresponding hook body 161. Under the acting force of the torsional springs 15, the hook bodies 161 are attached to the foot supports 30, and thus, an acting force for inward folding is applied to the hook bodies 161 and the foot supports 30 all the time. Based on this configuration, when the multifunctional grandstand chair is folded into a grandstand chair, the foot supports are not prone to being unfolded automatically, and thus, structural stability is improved. Meanwhile, when the multifunctional grandstand chair serves as a grandstand chair, the hooks 163 are hooked on a grandstand, and thus, the chair is unlikely to move when people lie backwards on the chair. Under the torsional force of the torsional springs 15, the hook components 16 automatically restore when not used. Furthermore, the front end of each hook 163 is provided with a cap 18, which is chamfered to prevent scratches to people.

Although the invention is specifically demonstrated and introduced with preferred embodiments, those skilled in this field would appreciate that various transformations of the invention can be made in forms and details without deviating from the spirit and scope defined by the Claims of the invention, and all these transformations should fall within the protection scope of the invention.

What is claimed is:

1. A multifunctional grandstand chair, including a chair frame, a cushion movably arranged on the chair frame, and backrest cloth, wherein the chair frame includes a base frame and a backrest tube pivoted to a rear end of the base frame; characterized in that the chair frame further includes two foot supports respectively pivoted to two sides of the base frame and capable of being inwards folded onto the base frame or outwards unfolded to support the base frame; the base frame includes base frame cross rods respectively located at a front end and a rear end and base frame tubes respectively located a left end and a right end, each said base frame tube is a vertically-arranged annular tube and includes a first tube section located at an upper end, a second tube section located at a lower end and two connecting tubes connected between the first tube section and the second tube section, and the cushion is arranged on the first tube sections of the two base frame tubes; and the multifunctional grandstand chair further includes fixed connecting pieces connected between the base frame and the foot supports to limit a maximum unfolding angle of the foot supports; the multifunctional grandstand chair further includes first foot pads and second foot pads, a gap is reserved between the second tube section and one said connecting tube of each said base frame tube, the first foot pads are disposed around the second tube sections via the gaps, each said second foot pad is provided with two connecting grooves and disposed at the corresponding gap, and the second tube section and the corresponding connecting tube of each said base frame tube are respectively connected to the two connecting grooves of the corresponding second foot pad.

2. The multifunctional grandstand chair according to claim 1, wherein each said first food pad is provided with a hook structure including a hook component and a torsional spring and is formed with a first installation hole, wherein the torsional spring is fixed in the installation hole, the hook component includes a hook body, a connecting shaft and a hook, the connecting shaft and the hook are respectively arranged at two ends of the hook body, the connecting shaft is rotatably arranged in the installation hole, and the torsional spring acts on the hook body; and under an acting force of the torsional springs, the hook bodies are attached to the foot supports, so that an acting force for inwards folding is applied to the hook bodies and the foot supports all the time.

3. The multifunctional grandstand chair according to claim 2, wherein the hook of each said hook component is sleeved with a cap.

4. The multifunctional grandstand chair according to claim 1, wherein each said foot support is a u-shaped tube and includes two vertical foot tubes and a cross foot tube connected between the two vertical foot tubes, an open end of each said foot support is pivoted on the base frame, and the cross foot tube of each said foot support is supported on the ground.

5. The multifunctional grandstand chair according to claim 4, wherein each cross foot tube is provided with a third foot pad.

6. The multifunctional grandstand chair according to claim 1, wherein each fixed connecting piece includes two connecting rods hinged together, wherein the two connecting rods are respectively hinged to the base frame and the corresponding foot support, and when the two connecting rods are completely unfolded, an unfolding angle between the corresponding foot support and the base frame is limited.

7. The multifunctional grandstand chair according to claim 1, wherein the backrest tube is an n-shaped tube and includes two vertical backrest tube sections and a cross backrest tube section connected to upper ends of the two vertical backrest tube sections, an open end of the backrest tube is pivoted to the base frame, and the backrest cloth is arranged between the two vertical backrest tube sections.

8. The multifunctional grandstand chair according to claim 7, wherein each of the two vertical backrest tube sections is pivoted to the rear end of the base frame through a rotary connecting piece, said rotary connecting piece is connected to the base frame and capable of being folded forwards.

* * * * *